US009099765B2

(12) United States Patent
Behin

(10) Patent No.: US 9,099,765 B2
(45) Date of Patent: Aug. 4, 2015

(54) DEVICE HAVING A QUADRATURE NEAR FIELD COMMUNICATION ANTENNA

(75) Inventor: Rayhan Behin, Ottawa (CA)

(73) Assignee: BLACKBERRY LIMITED, Waterloo, Ontario (CA)

( * ) Notice: Subject to any disclaimer, the term of this patent is extended or adjusted under 35 U.S.C. 154(b) by 386 days.

(21) Appl. No.: 13/542,755

(22) Filed: Jul. 6, 2012

(65) Prior Publication Data

US 2014/0009348 A1 Jan. 9, 2014

(51) Int. Cl.

| | |
|---|---|
| ***H01Q 21/00*** | (2006.01) |
| ***H01Q 7/00*** | (2006.01) |
| ***H01Q 7/06*** | (2006.01) |
| ***H01Q 1/22*** | (2006.01) |
| ***H01Q 21/29*** | (2006.01) |

(52) U.S. Cl.
CPC ..... *H01Q 7/00* (2013.01); *H01Q 1/2216* (2013.01); *H01Q 7/06* (2013.01); *H01Q 21/00* (2013.01); *H01Q 21/29* (2013.01)

(58) Field of Classification Search
USPC ..... 343/726, 728, 741, 787, 866, 702
See application file for complete search history.

(56) References Cited

U.S. PATENT DOCUMENTS

| | | | | |
|---|---|---|---|---|
| 5,978,655 | A * | 11/1999 | Ohura et al. | 455/41.1 |
| 7,106,269 | B1 | 9/2006 | Tonn | |
| 2006/0132352 | A1 * | 6/2006 | Schantz et al. | 342/125 |
| 2008/0303673 | A1 | 12/2008 | Oung et al. | |
| 2010/0277387 | A1 | 11/2010 | Schantz et al. | |
| 2012/0007787 | A1 | 1/2012 | Schantz et al. | |
| 2012/0071088 | A1 | 3/2012 | Cordier | |
| 2012/0262357 | A1 * | 10/2012 | Kato et al. | 343/788 |

FOREIGN PATENT DOCUMENTS

| | | | |
|---|---|---|---|
| EP | 0186483 | A2 | 7/1986 |
| EP | 1041503 | A1 * | 10/2000 |
| EP | 1953862 | A1 | 8/2008 |
| EP | 2293383 | A2 | 3/2011 |

OTHER PUBLICATIONS

European Patent Application No. 12175229.9 Search Report dated Nov. 16, 2012.

The RFID Tag Antenna: Orientation Sensitivity http://www.impinj.com/searchresults.aspx?searchtext=orientation published Apr. 22, 2010.

* cited by examiner

*Primary Examiner* — Dieu H Duong
(74) *Attorney, Agent, or Firm* — Perry + Currier, Inc.

(57) ABSTRACT

A device having a quadrature near field communication antenna is provided. The device comprises: a housing having; a first NFC (near field communication) antenna comprising a coil about parallel to a given side of the housing enabled to produce a first magnetic field that extends from the given side of the housing; a second NFC antenna about parallel with the first NFC antenna, the second NFC antenna comprising at least one respective coil forming two opposing current loops enabled to produce a second magnetic field perpendicular to the first magnetic field; and, a circuit for operating the first NFC antenna and the second NFC antenna in quadrature phase.

16 Claims, 13 Drawing Sheets

FRONT

REAR

DEVICE HAVING A QUADRATURE NEAR FIELD COMMUNICATION ANTENNA

FIELD

The specification relates generally to antennas, and specifically to a device having a quadrature near field communication antenna.

BACKGROUND

Signals from current near field communication (NFC) antennas in hand held devices, such as smart phones, extend from a rear side of the device requiring a hand-grip change to align the rear side of the device with NFC readers and/or NFC tags such that the signals can interact with the NFC readers and/or NFC tags.

BRIEF DESCRIPTIONS OF THE DRAWINGS

For a better understanding of the various implementations described herein and to show more clearly how they may be carried into effect, reference will now be made, by way of example only, to the accompanying drawings in which.

DETAILED DESCRIPTION

Figure 1:
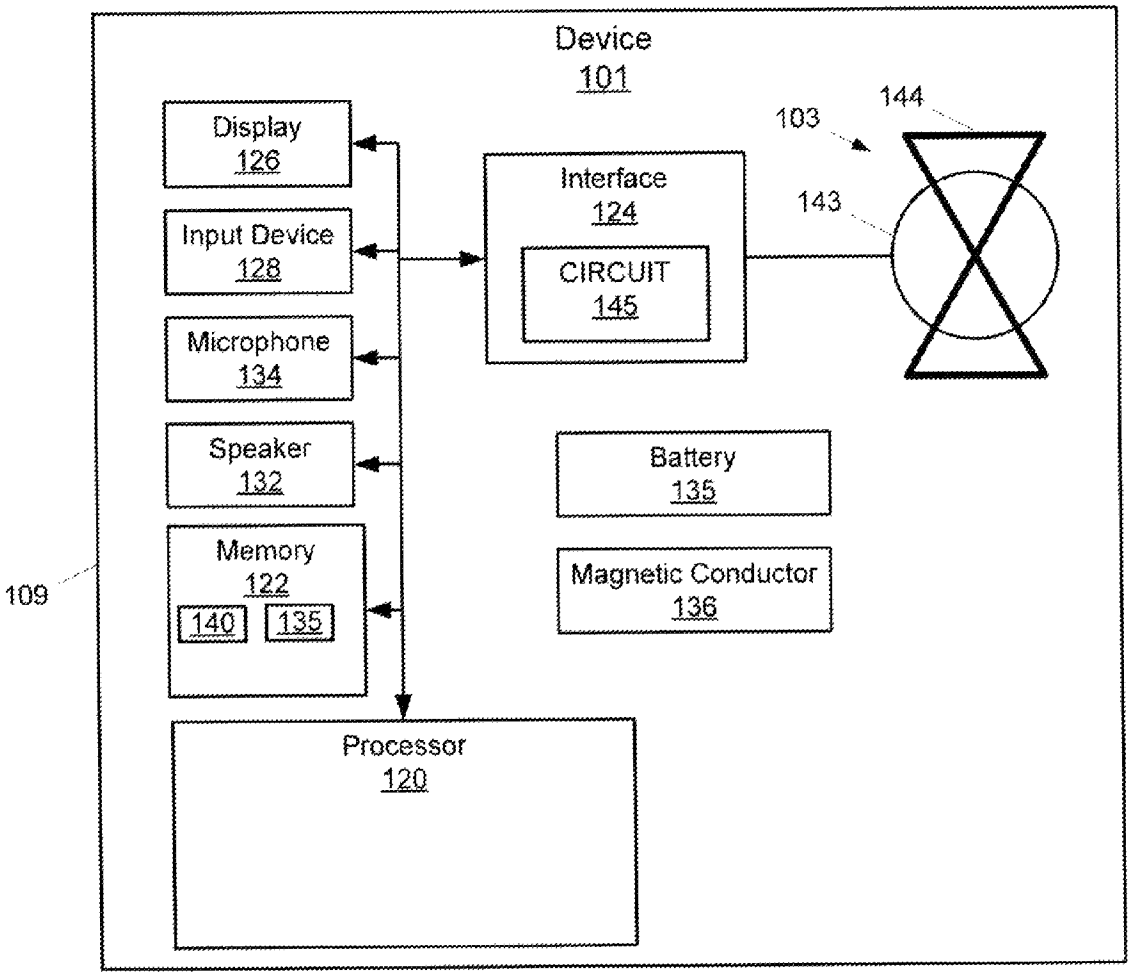
FIG. 1 depicts a schematic diagram of a device having a quadrature near field communication (NFC) antenna, according to non-limiting implementations.

An aspect of the specification provides a device comprising: a housing; a first NFC (near field communication) antenna comprising a coil about parallel to a given side of the housing enabled to produce a first magnetic field that extends from the given side of the housing; a second NFC antenna about parallel with the first NFC antenna, the second NFC antenna comprising at least one respective coil forming two opposing current loops enabled to produce a second magnetic field perpendicular to the first magnetic field; and, a circuit for operating the first NFC antenna and the second NFC antenna in quadrature phase.

The first NFC antenna can comprise a loop antenna.

The current in the two opposing current loops of the at least one respective coil can flow in opposite directions to produce the second magnetic field.

The second NFC antenna can comprise a bowtie antenna.

The second NFC antenna can comprise one or more of a bowtie antenna, a double D coil, a butterfly antenna and a figure eight antenna.

The second magnetic field can leak from the given side of the housing, about parallel to the given side, when operated by the circuit.

The device of claim can further comprise a magnetic conductor for containing respective portions of the first magnetic field and the second magnetic field internal to the device such that at least a local net portion of the first magnetic field leaks from the given side of the housing perpendicular thereto and at least a respective local net portion of the second magnetic field leaks from the given side of the housing, about parallel to the given side, when operated by the circuit.

The device can further comprise a processor enabled to: control the circuit; and, one or more of receive and transmit data via the first NFC antenna and the second NFC antenna.

The first magnetic field and the second magnetic field can form components of a circularly polarized magnetic field.

The circuit can comprise an LC (inductor-capacitor) quadrature splitter.

The device can further comprise a transceiver in communication with the first NFC antenna and the second NFC antenna, and the circuit can comprise a phase controlled differential driver of an RF interface of the transceiver.

The device can further comprise a third NFC antenna about parallel with the first NFC antenna and the second NFC antenna, the third NFC antenna comprising at least two further coils enabled to produce a third magnetic field extending from the housing, perpendicular to the first magnetic field and the second magnetic field. The third NFC antenna can partially overlap the second NFC antenna, and can be rotated about 90° thereto to decouple the third NFC antenna from the second NFC antenna.

Another aspect of the specification provides a method comprising: operating a first NFC (near field communication) antenna to produce a first magnetic field that extends from the given side of a housing of a device, the first NFC antenna comprising a coil about parallel to a given side of the housing; and, operating a second NFC antenna in quadrature phase with the first NFC antenna to produce a second magnetic field perpendicular the first magnetic field, the second NFC antenna about parallel with the first NFC antenna, the second NFC antenna comprising at least one respective coil forming two opposing current loops enabled to produce the second magnetic field.

The method can further comprise one or more of receiving and transmitting data via the first NFC antenna and the second NFC antenna.

The method can further comprise: operating a third NFC antenna in quadrature phase with the first NFC antenna to produce a third magnetic field perpendicular the first magnetic field and the second magnetic field, the third NFC antenna comprising at least two further coils enabled to produce the third magnetic field Another aspect of the specification provides a computer program product, comprising a computer usable medium having a computer readable program code adapted to be executed to implement a method comprising: operating a first NFC (near field communication) antenna to produce a first magnetic field that extends from a given side of a housing of a device, the first NFC antenna comprising a coil about parallel to the given side of the housing; and, operating a second NFC antenna in quadrature phase with the first NFC antenna to produce a second magnetic field extending from the housing perpendicular the first magnetic field, the second NFC antenna about parallel with the first NFC antenna, the second NFC antenna comprising at least at least one respective coil forming two opposing current loops enabled to produce the second magnetic field. The computer program product can comprise a non-transitory computer program product. The method can further comprise one or more of receiving and transmitting data via the first NFC antenna and the second NFC antenna. The method can further comprise: operating a third NFC antenna in quadrature phase with the first NFC antenna to produce a third magnetic field extending from the housing perpendicular the first magnetic field and the second magnetic field, the third NFC antenna comprising at least two further coils enabled to produce the third magnetic field.

FIG. 1 depicts a schematic diagram of a device 101 comprising a quadrature near field communication (NFC) antenna 103, according to non-limiting implementations. Device 101 comprises a housing 109 containing a processor 120 interconnected with a memory 122, a communications interface 124 connected to antenna 103, a display 126, an input device 128, a speaker 132, a microphone 134, a battery 135 and a magnetic conductor 136. Quadrature near field communication antenna 103 will be interchangeably referred to hereafter as antenna 103. Communications interface 124 will be interchangeably referred to as interface 124. As will be presently explained, antenna 103 comprises a first NFC antenna 143 enabled to produce a first magnetic field, and a second NFC antenna 144 enabled to produce a second magnetic field perpendicular the first magnetic field, second NFC antenna 144 about parallel to first NFC antenna 143. Further, interface 124 comprises a circuit 145 enabled to operate first NFC antenna 143 and second NFC antenna 144 in quadrature phase.

It is further appreciated that while present implementations will be described with reference to respective magnetic fields of each of first NFC antenna 143 and second NFC antenna 144 leaking from a rear side of device 101, in other implementations, first NFC antenna 143 and second NFC antenna 144 can be arranged such that respective magnetic fields leak from any given side of device 101 including, but not limited to, the rear side, a front side, a top side, a bottom side, a left side or a right side.

Figure 2:
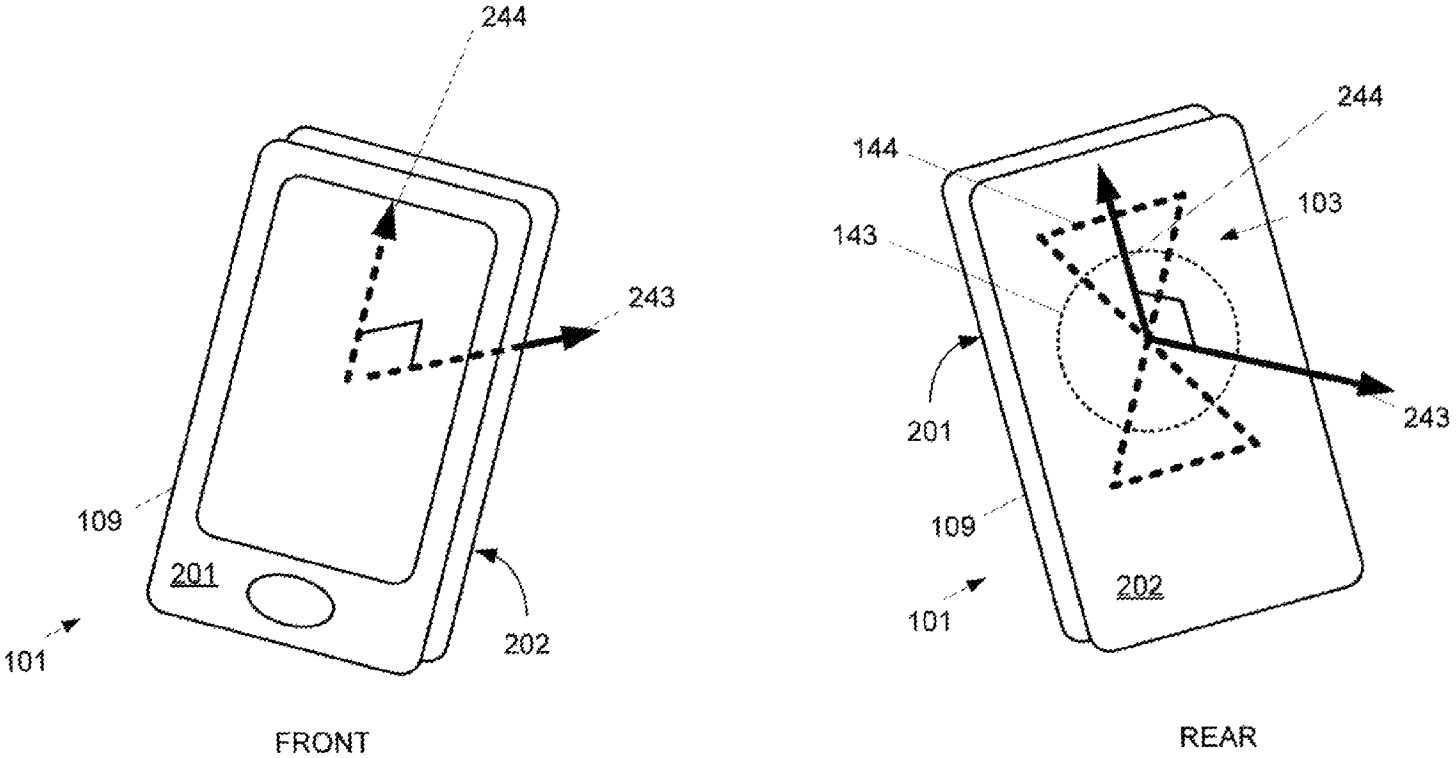
FIG. 2 depicts front and rear perspective views of the device of FIG. 1, as well as relative location of the quadrature NFC antenna, according to non-limiting implementations.

In any event, attention is next directed to FIG. 2 which depicts front and rear perspective views of device 101; in the rear view of device 101, a relative position of antenna 103 is depicted with respect to a front side 201 and a rear side 202 of housing 109. It is appreciated that antenna 103 is depicted in broken lines in FIG. 2 to indicate that antenna 103 is internal to device 101 and contained within housing 109.

In any event, from FIG. 2, it is apparent that first NFC antenna 143 comprises a coil about parallel to rear side 202 of housing 109, and hence antenna 143 is enabled to produce a first magnetic field 243 that extends from rear side of housing 109, as best seen in the rear perspective view of device 101. First NFC antenna 143 will be explained in more detail with respect to FIG. 3.

It is furthermore apparent from FIG. 2 that second NFC antenna 144 comprises at least one respective coil forming two opposing current loops about parallel to rear side 202 of housing 109 enabled to produce a second magnetic field 244 perpendicular to first magnetic field 243, extending along rear side 202 towards a top edge of rear side 202. Further, in depicted implementations, second NFC antenna 144 comprises a bowtie coil, and hence each of the two opposing current loops are formed by a coil having a double-triangle structure as will be explained in more detail with respect to FIG. 4. In the front view of device 101 in FIG. 2, first magnetic field 243 and second magnetic field 244 are shown in broken lines to indicate they are located behind device 101.

It is appreciated that the terms front, rear, left, right, top and bottom will be used herein to refer to sides and/or edges of device 101 and/or housing 109: for example, a front side comprises a side where display 126 is provided; a rear side comprises a side about parallel and opposite to the front side; a left side comprises a side to the left of the front side when display 126 is being viewed, and joining the front side to the rear side; a right side comprises a side to the right of the front side when display 126 is being viewed, and joining the front side to the rear side; a top side comprises a side above the front side when display 126 is being viewed, and joining the front side to the rear side; and a rear side comprises a side below the front side when display 126 is being viewed, and joining the front side to the rear side. It is further appreciated that bottom side, top side, left side and right side generally comprise the depth of device 101 and/or housing 109. Edges can be similarly referred to.

In any event, device 101 can be any type of electronic device that can be used in a self-contained manner to communicate using antenna 103. Device 101 includes, but is not limited to, any suitable combination of electronic devices, communications devices, computing devices, personal computers, laptop computers, portable electronic devices, mobile computing devices, portable computing devices, tablet computing devices, laptop computing devices, desktop phones, telephones, PDAs (personal digital assistants), cellphones, smartphones, e-readers, internet-enabled appliances, payment devices, portable speakers, portable headsets and the like. Other suitable devices are within the scope of present implementations. In some implementations, device 101 can communicate with communication networks.

In particular, device 101 is enabled to interact with NFC devices, including but not limited to NFC readers, NFC tags and the like, via antenna 103. In some particular non-limiting implementations, device 101 comprises an NFC devices enabled to interact with, and exchange data with, other NFC devices, including but not limited to one or more of NFC readers, NFC tags, and the like.

Attention is now directed back to the schematic diagram of device 101 in FIG. 1. It should be emphasized that the structure of device 101 in FIG. 1 is purely an example, and contemplates a device that can be used for both implementing telephony functions and optionally wireless voice (e.g. telephony) and wireless data communications (e.g. email, web browsing, text, and the like). Indeed, FIG. 1 contemplates a device that can be used for implementing NFC functions, as well as any other specialized functions, including, but not limited, to one or more of, telephony, computing, appliance, payment systems, and/or entertainment related functions.

Device 101 can comprise at least one input device 128 generally enabled to receive input data, and can comprise any suitable combination of input devices, including but not limited to a keyboard, a keypad, a pointing device, a mouse, a track wheel, a trackball, a touchpad, a touch screen and the like. Other suitable input devices are within the scope of present implementations.

Input from input device 128 is received at processor 120 (which can be implemented as a plurality of processors, including but not limited to one or more central processors (CPUs)). Processor 120 is configured to communicate with a memory 122 comprising a non-volatile storage unit (e.g. Erasable Electronic Programmable Read Only Memory ("EEPROM"), Flash Memory) and a volatile storage unit (e.g. random access memory ("RAM")). Programming instructions that implement the functional teachings of device 101 as described herein are typically maintained, persistently, in memory 122 and used by processor 120 which makes appropriate utilization of volatile storage during the execution of such programming instructions. Those skilled in the art will now recognize that memory 122 is an example of computer readable media that can store programming instructions executable on processor 120. Furthermore, memory 122 is also an example of a memory unit and/or memory module.

Processor 120 can be further configured to communicate with display 126, and microphone 134 and speaker 132. Display 126 comprises any suitable one of, or combination of, CRT (cathode ray tube) and/or flat panel displays (e.g. LCD (liquid crystal display), plasma, OLED (organic light emitting diode), capacitive or resistive touchscreens, and the like). Microphone 134 comprises any suitable microphone for receiving sound data. Speaker 132 comprises any suitable speaker for providing sound data, audible alerts, audible communications from remote communication devices, and the like, at device 101.

In some implementations, input device 128 and display 126 are external to device 101, with processor 120 in communication with each of input device 128 and display 126 via a suitable connection and/or link.

Processor 120 also connects to interface 124, which is enabled to communicate with NFC devices via antenna 103. Specifically, interface 124 comprises a circuit for operating antenna 103 in quadrature phase, as will be explained in further detail below.

However, in some implementations, interface 124 can be optionally implemented as one or more radios and/or connectors and/or network adaptors, configured to wirelessly communicate with one or more communication networks (not depicted). It will be appreciated that interface 124 can be configured to correspond with network architecture that is used to implement one or more communication links to one or more communication networks, including but not limited to any suitable combination of USB (universal serial bus) cables, serial cables, wireless links, cell-phone links, cellular network links (including but not limited to 2G, 2.5G, 3G, 4G+, UMTS (Universal Mobile Telecommunications System), CDMA (Code division multiple access), WCDMA (Wideband CDMA), FDD (frequency division duplexing), TDD (time division duplexing), TDD-LTE (TDD-Long Term Evolution), TD-SCDMA (Time Division Synchronous Code Division Multiple Access) and the like, wireless data. Bluetooth links, GPS links, satellite positioning, NFC (near field communication) links, WiFi links, WiMax links, packet based links, the Internet, analog networks, the PSTN (public switched telephone network), access points, and the like, and/or a combination.

When interface 124 is configured to communicate with one or more communication networks, interface 124 can comprise further appropriate antennas there for (not depicted).

It is yet further appreciated that device 101 comprises battery 135 or any other suitable power source.

It is yet further appreciated that device 101 comprises a magnetic conductor 136, including but not limited to one or more a magnetic permeable material and a ferrite core.

However, in some implementations, battery 135 comprises magnetic conductor 136: in other words, in these implementations, battery 135 can comprise, as a non-limiting example, a ferrite core.

Whether as a standalone component, or as an element of battery 135, magnetic conductor 136 is arranged relative to NFC antenna 103 for containing a portion of magnetic fields 243 and 244 internal to device 101 such that at least a local net portion of magnetic fields 243 and 244 leak from rear side 202 of housing 109 and about parallel and perpendicular to rear side 202 when operated by circuit 145, as described below with reference to FIG. 5. It is furthermore appreciated that magnetic conductor 136 is about planar and can comprise a sheet of magnetic permeable material.

In any event, it should be understood that a wide variety of configurations for device 101 are contemplated.

Figure 3:
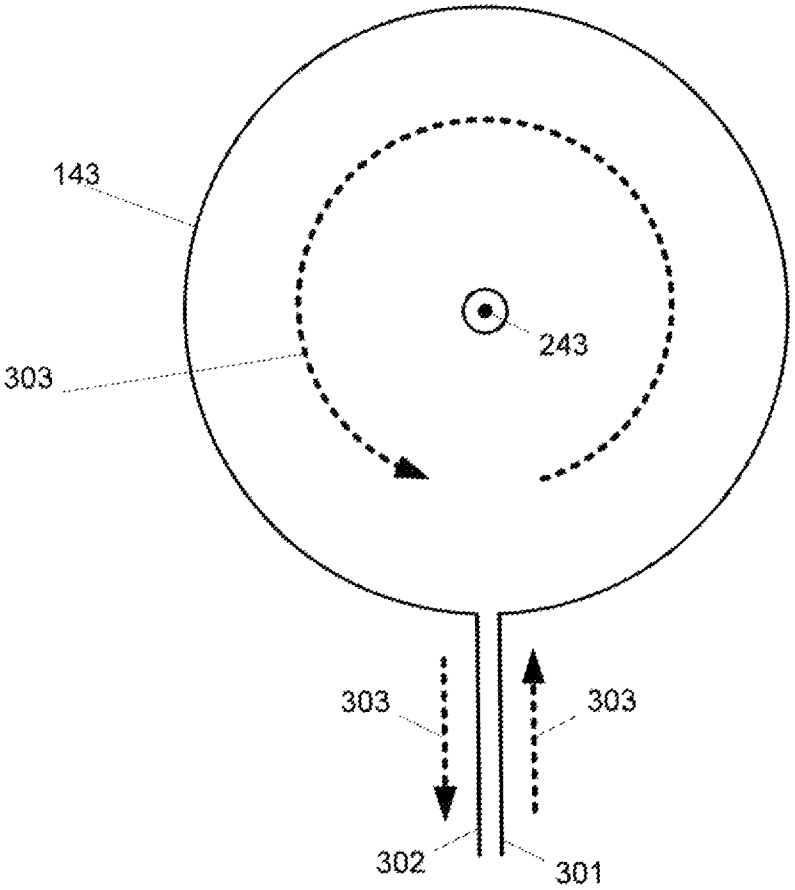
FIG. 3 depicts operation of a first NFC antenna comprising a single coil, according to non-limiting implementations.

Attention is next directed to FIG. 3, which depicts first NFC antenna 143 in more detail. In depicted implementations, first NFC antenna 143 comprises a coil (e.g. a loop antenna) forming a current loop, with leads 301, 302 (which connect to circuit 145) supplying a current 303. It is appreciated that first NFC antenna 143 is depicted, in. FIG. 3, as viewed from rear side 202 of device 101, and further that current 303 is supplied from lead 301: hence current 303 takes a counter-clockwise path around first NFC antenna 143 resulting in first magnetic field 243 going out of the page (e.g. using the right hand rule). With further reference to FIG. 2, this results in first magnetic field 243 being about perpendicular to, and extending from, rear side 202 of housing 109 as first NFC antenna 143 is about parallel to rear side 202.

Further, while first NFC antenna 143 is depicted as circular, first NFC antenna 143 can be any suitable shape as long as a current loop is formed and first magnetic field 243 is about perpendicular to rear side 202.

Further, while leads 301, 302 are depicted at a bottom side of first NFC antenna 143, in other implementations leads 301, 302 can be at any other position on first NFC antenna 143 as long as a current loop is formed and first magnetic field 243 is about perpendicular to rear side 202. Indeed, first NFC antenna 143 can comprise any suitable number of turns in the coil with leads 301, 302 connected thereto at any suitable position along the turns.

Further, first NFC antenna 143 need not be perfectly parallel to rear side 202, and hence first magnetic field 243 need not be perfectly perpendicular rear side 202, as long as first magnetic field 243 is about perpendicular to and/or extends from rear side 202.

Figure 4:
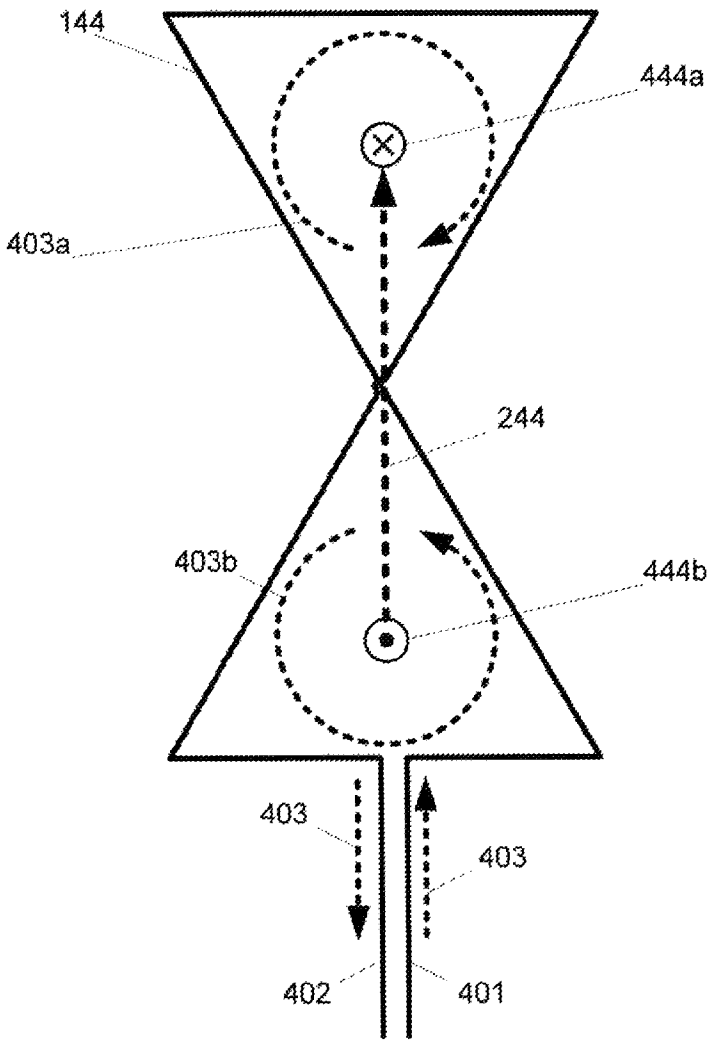
FIG. 4 depicts operation of a second NFC antenna comprising at least one coil forming two opposing current loops, according to non-limiting implementations.

Attention is next directed to FIG. 4, which depicts second NFC antenna 144 in more detail. In depicted implementations, second NFC antenna 144 comprises a bowtie coil with leads 401, 402 (which connect to circuit 145) supplying a current 403. It is appreciated that second NFC antenna 144 is depicted, in FIG. 4, as viewed from rear side 202 of device 101, and further that current 403 is supplied from lead 401.

It is further appreciated, that second NFC antenna 144 hence comprises a coil forming a double triangle structures, which generally form two current loops, 403*a*, 403*b*, with current path 403*a* being clockwise and current path 403*b* being counter clockwise. It is appreciated that the double triangle structure is formed by a single coil in a FIG. 8 shape, but with each of the loops in the FIG. 8 having a triangle shape. Furthermore, the triangles are formed by the coil crossing over in the middle of the double triangle structure (physically crossing but not electrically crossing; in other words, the coil does not short at the cross over point). As such, the bottom current loop 403*b* is formed by current 403 entering second NFC antenna 144 via lead 401, flowing counter clockwise to the cross over point, where clockwise current loop 403*a* is formed, and then exiting current loop 403*a* at the cross over point, to again flow counter clockwise to form the remainder of the bottom current loop 403*b* before exiting via lead 402. In other words, in these implementations, second NFC antenna comprises at least one coil which forms two opposing current loops. It is further appreciated that a similar structure could be formed without a crossover point by two coils, for example if each of leads 401, 402 were located at about the depicted crossover point, such that each of the top triangle and bottom triangle each formed a continuous loop connected at their apexes (i.e. the current cross over point). In other words, the structure that forms the two opposing current loops is generally non-limiting and the two opposing current loops can be formed by any suitable number of coils.

In any even, again using the right hand rule, current path 403*a* results in a net magnetic field 444*a* going into the page, and current path 403*b* results in a net magnetic field 444*b* coming out of the page. The near fields of magnetic field 444*a* and magnetic field 444*b* generally cancel each other out perpendicular to rear side 202, however as depicted in further detail in FIG. 5 described below, due to the presence of magnetic conductor 136 along one side of second NFC antenna 144, a local net magnetic field results along an opposite side of second NFC antenna 144, that is about perpendicular to net magnetic fields 444*a*, 444*b*. In other words, the field lines of magnetic field 444*b* come out of the page (thereby leaking from rear side 202), flow "up", and follow the field lines of magnetic field 444*a* going into the page (i.e. field lines flow from magnetic field 444*b* up to magnetic field 444*a*). It is further appreciated that second magnetic field 244 comprises the local net magnetic field, which hence results in second magnetic field 244 being about perpendicular to first magnetic field 243, as first magnetic field 243 is out of the page, when first NFC antenna 143 is viewed from a similar perspective as second NFC antenna 144 (i.e. the perspectives of each of FIGS. 3 and 4 are similar). While not depicted, it is further appreciated that magnetic conductor 136 similarly distorts field lines of magnetic field 243, that result in a net magnetic field about perpendicular to rear side 202.

Figure 5:
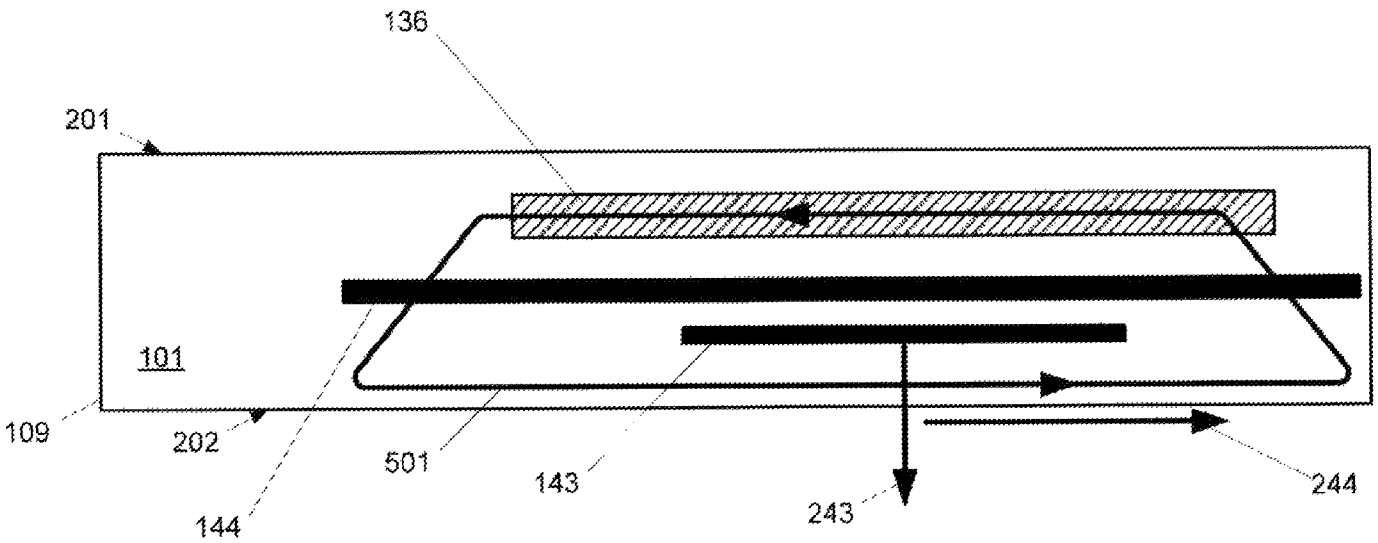
FIG. 5 depicts a schematic cross-section of the device of FIG. 1 depicting details of magnetic fields therein, according to non-limiting implementations.

Attention is next directed to FIG. 5 which depicts a schematic cutaway side view of device 101 showing relative positions of first NFC antenna 143, second NFC antenna 144, and magnetic conductor 136 within housing 109, according to non-limiting implementations. It is appreciated that, in these implementations, first NFC antenna 143 and second NFC antenna 144, are between magnetic conductor 136 and rear side 202, with NFC antenna 143 being the closest to rear side 202. However, second NFC antenna 144 can be closer to rear side 202. Indeed, it is appreciated that the order of first NFC antenna 143 and second NFC antenna 144 is generally non-limiting. However, it is appreciated that the order of first NFC antenna 143 and second NFC antenna 144 is generally non-limiting, and that magnetic conductor 136 serves both to distort the magnetic field of first antenna 143 and second antenna 144 and to shield first antenna 143 and second antenna 144 from other electronic, electric fields and magnetic fields generated in device 101. It is further appreciated that a right side of FIG. 5 corresponds to a top side of device 101.

In any event, FIG. 5 also depicts a portion of field lines 501 of second magnetic field 244 flowing through magnetic conductor 136, such that magnetic conductor 136 contains a portion of second magnetic field 244 internal to device 101 such that at least a local net portion of second magnetic field 244, as depicted, leaks from a rear side 202 of housing 109 when operated by circuit 145.

In other words, without magnetic conductor 136, second magnetic field 244 would be generally symmetrical, though opposite in direction, above and below second NFC antenna 144; but magnetic conductor 136 distorts second magnetic field 244 such that a local net portion of second magnetic field 244 leaks from rear side 202 of device 101, about perpendicular to first magnetic field 243. As such, magnetic conductor 136 comprises a sheet of dimensions suitable for distorting second magnetic field 144 as depicted. Hence, in some implementations, magnetic conductor 136 can be about planar and extending across the complete height and a width of first NFC antenna 143 and second NFC antenna 144. It is hence further appreciated that magnetic conductor 136 also shields first antenna 143 from other electronics in device 101, and further distorts field lines of first magnetic field 243 such that net first magnetic field 243 leaks from a rear side 202 of device 101 and is about perpendicular to rear side 202. In other words, magnetic conductor 136 is located such that magnetic fields 243, 244 towards front side 201 are concentrated in magnetic conductor 136 thereby not creating eddy currents with other metal objects at device 101 and leading to a cancelling field: hence, magnetic conductor 136 acts as a shield from metal for first NFC antenna 143 and second NFC antenna 144.

It is further appreciated that in implementations where magnetic fields 243, 244 leak from front side 201, the structure in FIG. 5 is reversed, with first NFC antenna 143 and second NFC antenna 244 located between front side 201 and magnetic conductor 136. Indeed, in implementations where magnetic fields 243, 244 leak from a specific given side, the structure in FIG. 5 is adjusted to align with the given side with first NFC antenna 143 and second NFC antenna 244 about parallel to the given side and located between the given side and magnetic conductor 136.

Returning to FIG. 4, while leads 401, 402 are depicted at a bottom side of second NFC antenna 144, in other implementations leads 401, 402 can be at any other position on second NFC antenna 144 as long as two current loops are formed and second magnetic field 244 is about perpendicular to first magnetic field 243. Further second NFC antenna 144 can comprise any suitable number of turns in the coils with leads 401, 402 connected thereto at any suitable position along the turns.

Figure 6:
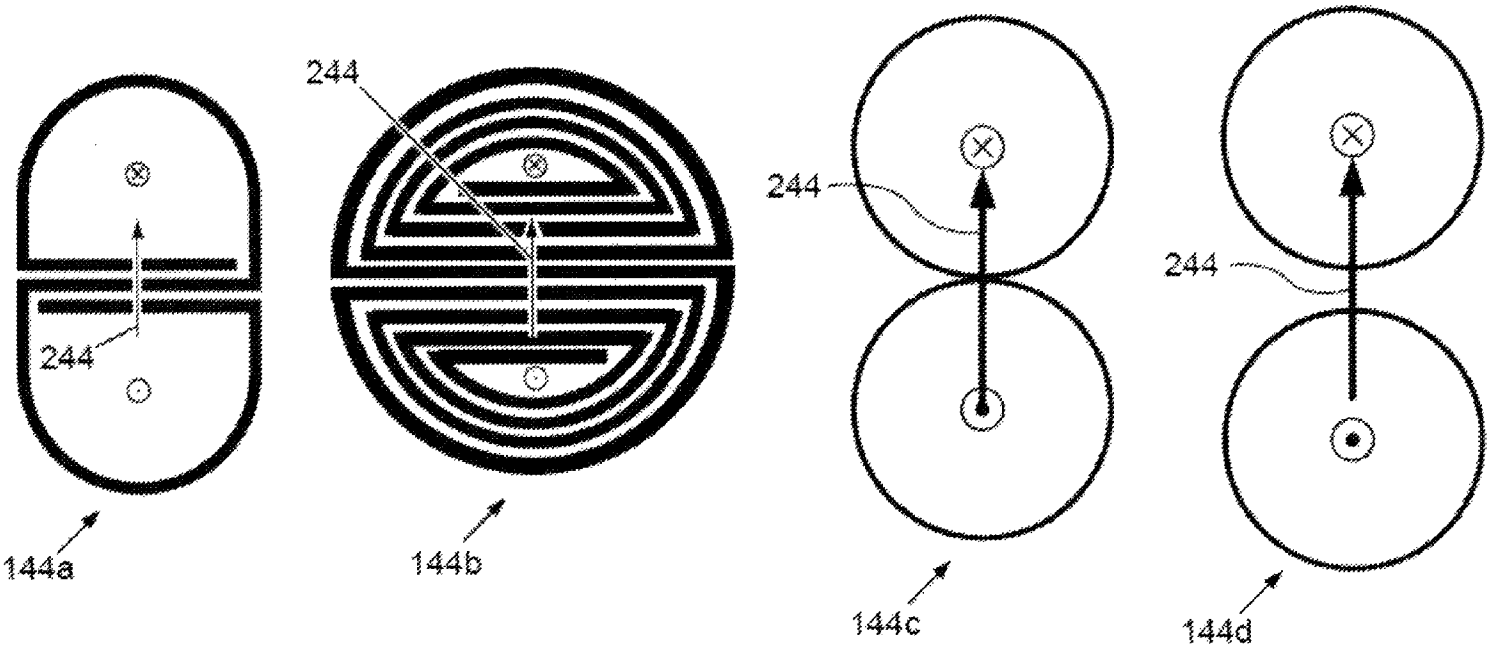
FIG. 6 depicts alternative implementations of the second NFC antenna of FIG. 4.

Attention is now directed to FIG. 6 which depicts alternative implementations of second NFC antenna 144. For example, in implementations described heretofore, second NFC antenna 144 comprises a bowtie antenna. However, second NFC antenna 144 can comprise any suitable antenna comprising at least one respective coil forming two opposing current loops to produce second magnetic field 244. Hence, second NFC antenna 244 can comprise one or more of a double D antenna 144*a*, a double D antenna 144*b*, a figure eight antenna 144*c*, and an antenna 144*d* comprising two coils forming current loops in opposite directions. While not depicted, second NFC antenna 144 can also comprise a butterfly antenna having any sort of wing shape. FIG. 6 also shows the direction of magnetic fields formed by each of antennas 144*a*, 144*b*, 144*c*, 144*d*, as well as second magnetic field 244, assuming each antenna 144*a*, 144*b*, 144*c*, 144*d* is being viewed from rear side 202 of device 101.

Comparing double D antennas 144*a*, 144*b* it is appreciated that each of the two coils in each of antenna 144*b* has more turns than antenna 144*a*; further each of antennas 144*a*, 144*b* can comprise any suitable number of turns, which can be co-centric or not co-centric. Similarly, each of the two coils in each of antennas 144, 144*a*, 144*b*, 144*c*, 144*d* can comprise any suitable number of turns.

Antennas 144*a*, 144*b* further depict leads that are not co-located as with leads 301, 302 and leads 401, 402. Hence, location leads in each of antennas 144, 144*a*, 144*b*, 144*c*, 144*d* are generally appreciated to be non-limiting.

Figure 7:
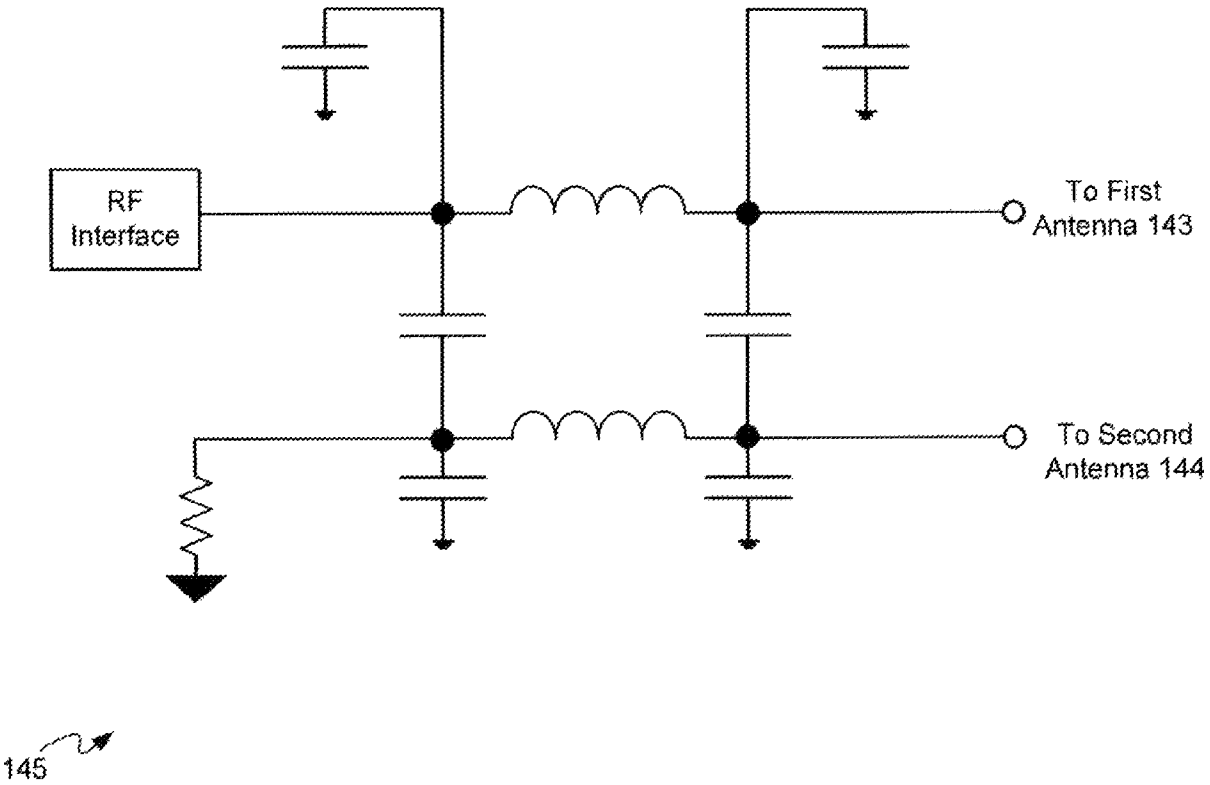
FIG. 7 depicts a circuit for operating the quadrature NFC antenna, according to non-limiting implementations.

Attention is next directed to FIG. 7, which depicts a non-limiting implementation of circuit 145, which comprises an LC (inductor-capacitor) quadrature splitter, with an RF (radio-frequency) interface connected to an RF transceiver as input, and respective lead 301, 401 to first NFC antenna 143 and second NFC antenna 144, which are in quadrature phase to one another. It is appreciated that leads 302, 402 are generally to ground. Though not depicted, circuit 145 can alternatively comprise a phase controlled differential driver of an RF interface of an RF transceiver of interface 124 driving antennas 143 and 144 differentially.

Figure 8:
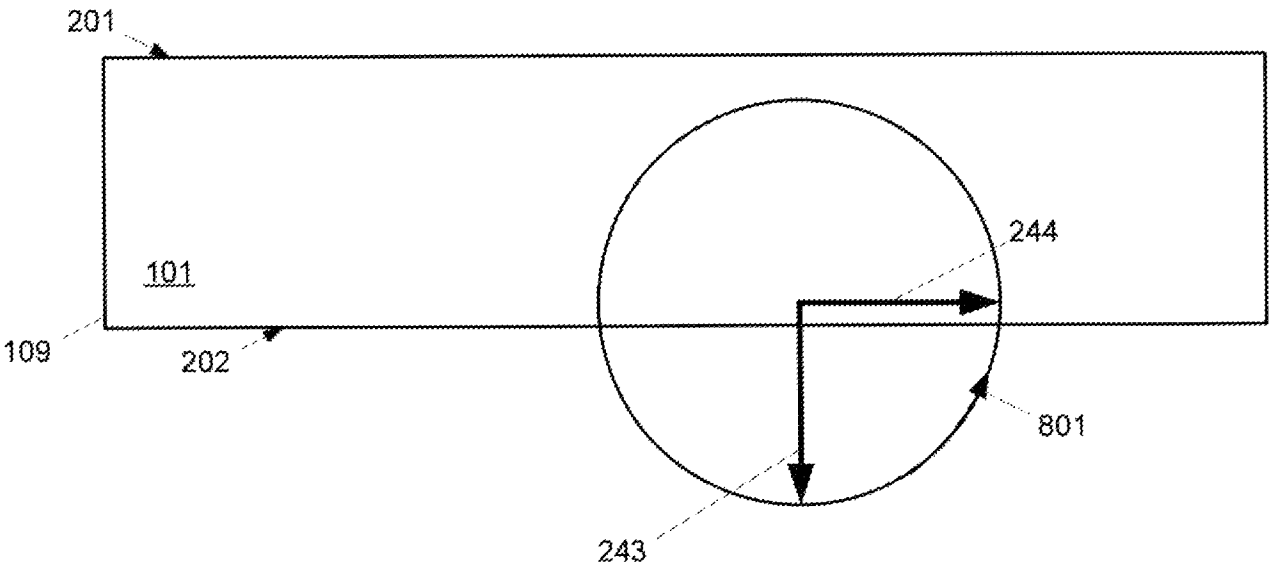
FIG. 8 depicts a total magnetic field extending from the device of FIG. 1 when operating the quadrature NFC antenna, according to non-limiting implementations.

Either way, as depicted in FIG. 8, which shows a side schematic view of device 101 and relative positions of first magnetic field 243 and second magnetic field 244 (with a right side of FIG. 8 corresponding to a top of device 101 as first magnetic 243 and second magnetic field 244 are 90° out of phase with one another, they form components of a circularly polarized magnetic field 801 that alternately extend from rear side 202 of device 101 and parallel to rear side 202 of device 101.

Figure 9:
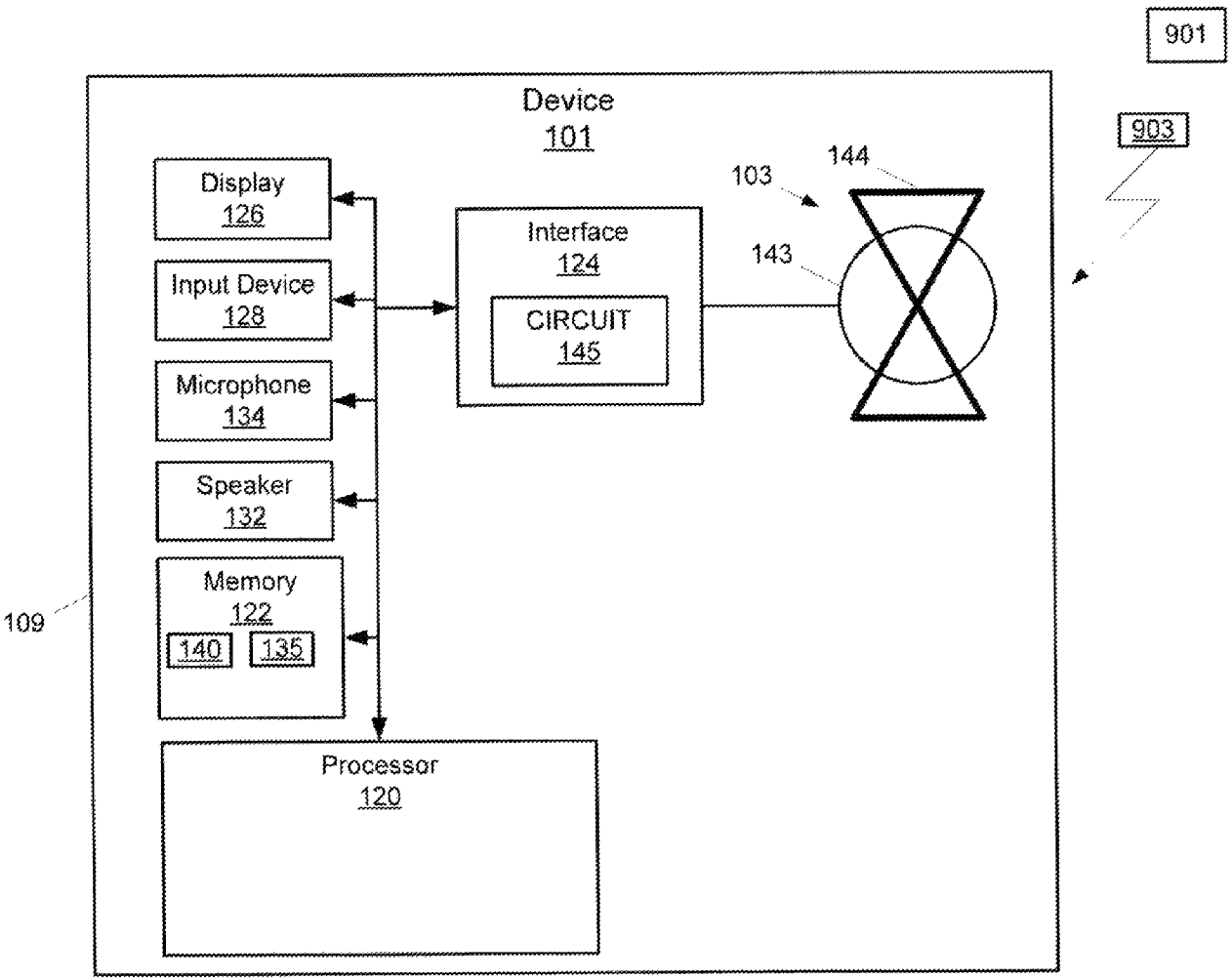
FIG. 9 depicts the device of FIG. 1 interacting with an external NFC device, according to non-limiting implementations.
Figure 10:
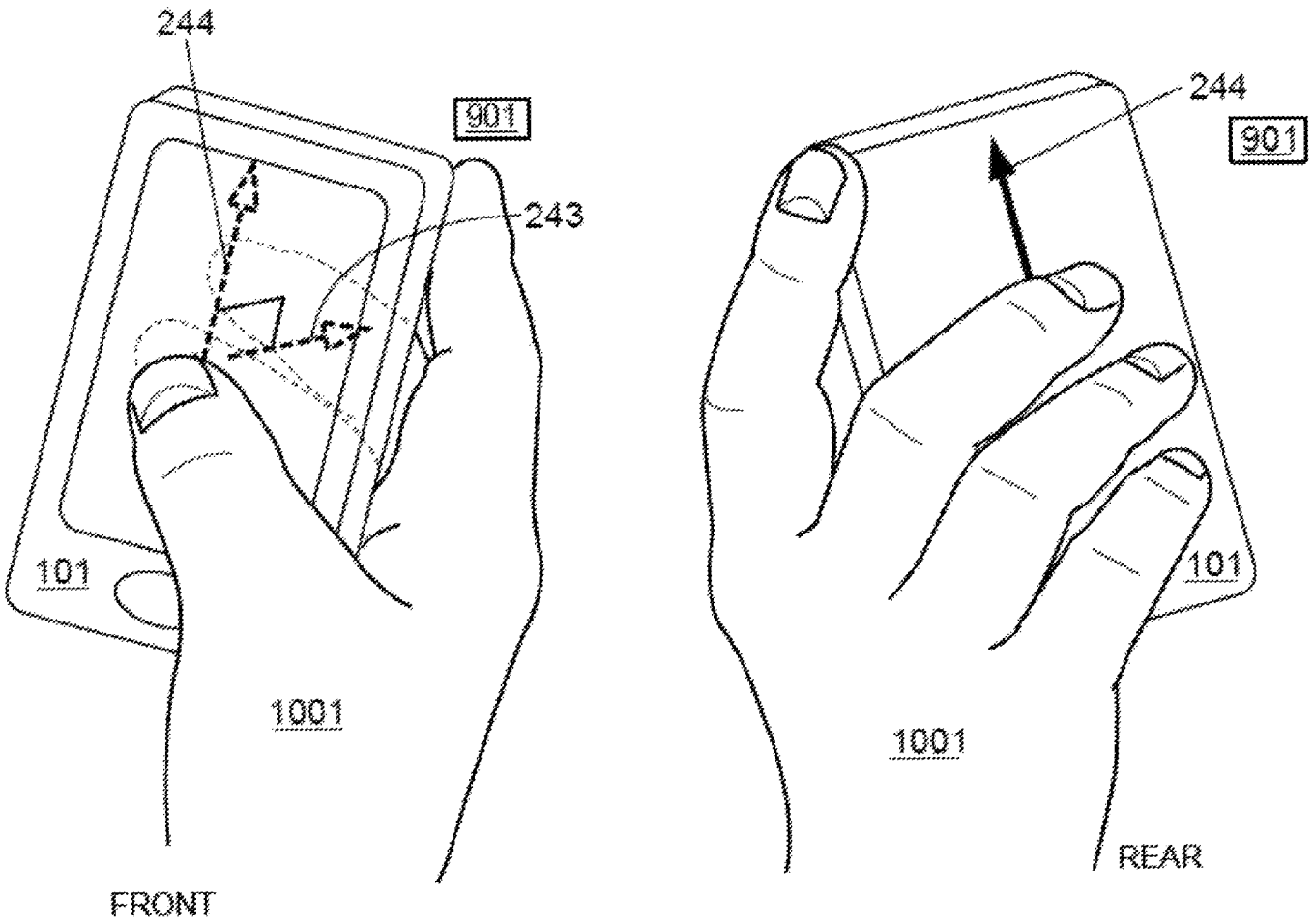
FIG. 10 depicts the device of FIG. 1 in use when being held by a hand of a user, the hand blocking the magnetic field produced by a first NFC antenna, according to non-limiting implementations.

Hence, as depicted in FIGS. 9 and 10, device 101 can be used detect an NFC device 901 when NFC device 901 is adjacent rear side 202, and/or located towards a top side of device 101 but along rear side 202. Thus, as depicted in FIG. 10, when a hand 1001 of a user holding device 101 blocks first magnetic field 243, second magnetic field 244 can be used to detect NFC device 901. Further, as depicted in FIG. 9, processor 120 can wirelessly receive, or alternatively transmit, data 903 via first NFC antenna 143 and second NFC antenna 144. For example device 901 can comprise one or more of payment terminal, smart poster tag, inventory terminal and the like.

Figure 11:
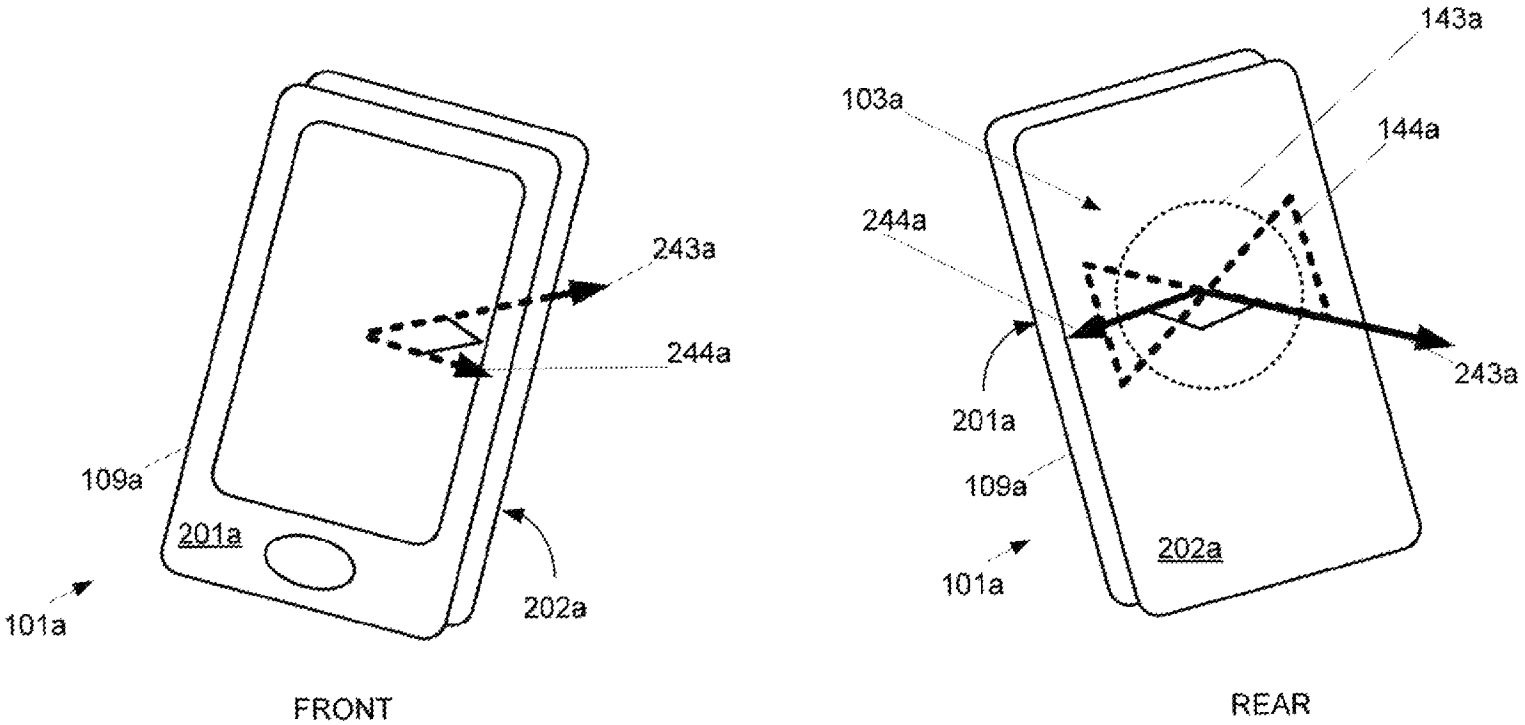
FIG. 11 depicts front and rear perspective views of an alternative implementation of a device having a quadrature near field communication (NFC) antenna, according to non-limiting implementations.

Attention is now directed to FIG. 11, which depicts front and rear perspective views of an alternative implementation of a device 101*a* comprising a quadrature NFC antenna 103*a*, according to non-limiting implementations. FIG. 11 is substantially similar to FIG. 2, with like elements having like numbers, but with an "a" appended thereto. Further, while an internal schematic of device 101*a* is not depicted, it is appreciated that device 101*a* is schematically similar to device 101 as depicted in FIG. 1, and hence device 101*a* comprises a housing 109*a* containing a processor interconnected with a memory, a communications interface connected to antenna 103*a* via a circuit, a display, an input device, a speaker, a microphone, a battery and, in some implementations, a magnetic conductor, each respectively similar to housing 109, processor 120, memory 122, interface 124, antenna 103, circuit 145, display 126, input device 128, speaker 132, microphone 134, battery 135 and magnetic conductor 136 as described above.

First NFC antenna 143*a* is similar to first NFC antenna 143, and produces a first magnetic field 243*a* that extends from a rear side 202*a* of housing 109*a*, and is about perpendicular to one or more of front side 201*a* and rear side 202*a*.

However, in contrast to device 101, second NFC antenna 144*a* is rotated 90° with respect to second NFC antenna 144, such that second magnetic field 244*a* is perpendicular to first magnetic field 243*a* but towards a left side or a right side of device 101*a*, rather than a top side.

Hence, in these implementations, to interact with an external NFC device, a left edge, right edge of rear side 202*a* can be held adjacent the NFC device.

Figure 12:
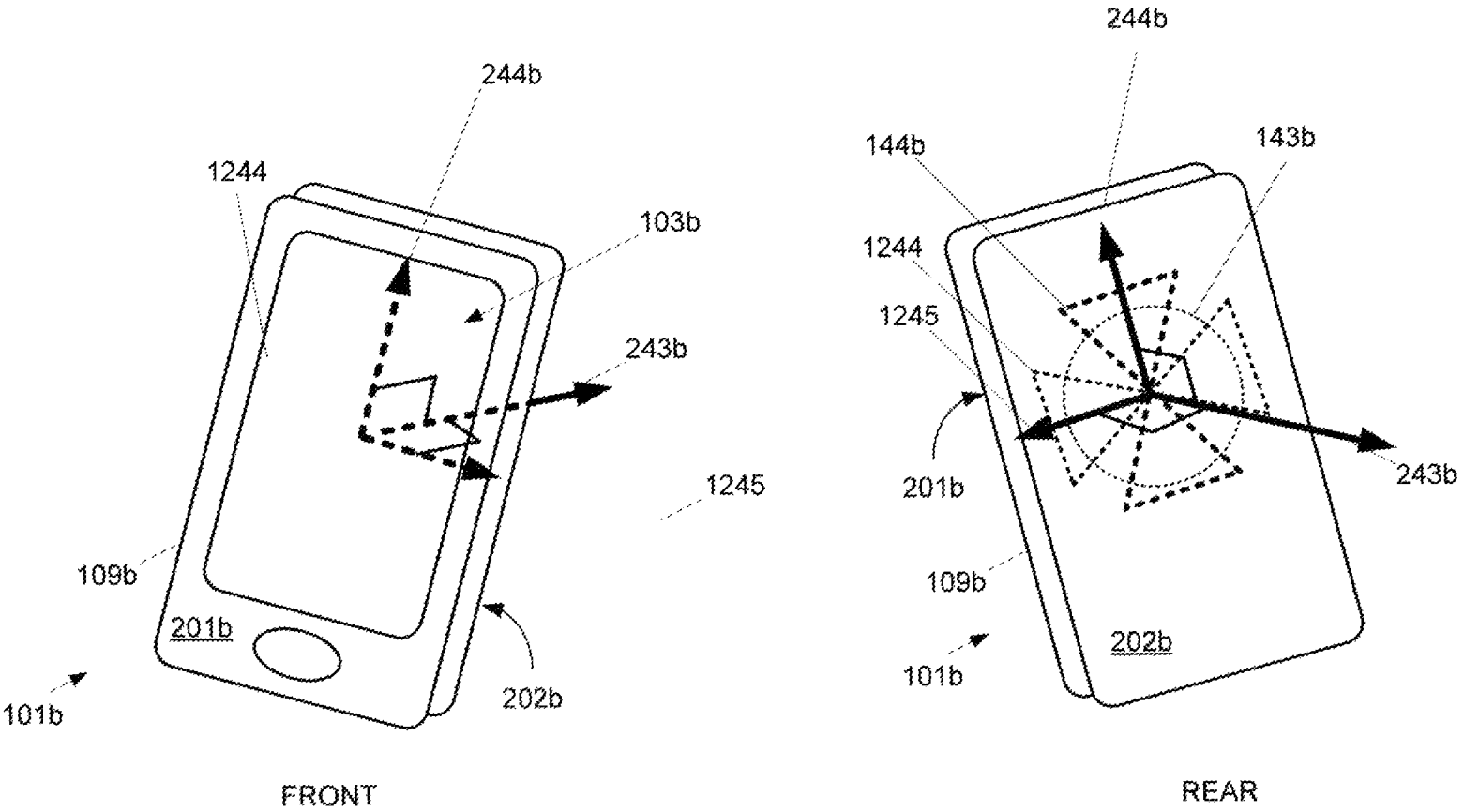
FIG. 12 depicts front and rear perspective views of an alternative implementation of a device having a quadrature near field communication (NFC) antenna with three perpendicular magnetic fields, according to non-limiting implementations.

Attention is now directed to FIG. 12, which depicts front and rear perspective views of an alternative implementation of a device 101*b* comprising a quadrature NFC antenna 103*b*, according to non-limiting implementations. FIG. 12 is substantially similar to FIG. 2, with like elements having like numbers, but with a "b" appended thereto. Further, while an internal schematic of device 101*b* is not depicted, it is appreciated that device 101*b* is schematically similar to device 101 as depicted in FIG. 1, and hence device 101*b* comprises a housing 109*b* containing a processor interconnected with a memory, a communications interface connected to antenna 103*b* via a circuit, a display, an input device, a speaker, a microphone, a battery and, in some implementations, a magnetic conductor, each respectively similar to housing 109, processor 120, memory 122, interface 124, antenna 103, circuit 145, display 126, input device 128, speaker 132, microphone 134, battery 135 and magnetic conductor 136 as described above.

First NFC antenna 143*b* is similar to first NFC antenna 143, and produces a first magnetic field 243*b* that extends from a rear side 202*b* of housing 109*b*, and is about perpendicular to one or more of front side 201*b* and rear side 202*b*. Second NFC antenna 144*b* is similar to first NFC antenna 144, and produces a second magnetic field 244*b* perpendicular first magnetic field 243*b* extending about parallel along rear side 202 towards a top edge of rear side 202.

However, in contrast to device 101, device 101*b* further comprises a third NFC antenna 1244 about parallel with first NFC antenna 143*b* and second NFC antenna 144*b*, third NFC antenna 1244 comprising at least two further coils enabled to produce a third magnetic field 1245 extending from housing 109*b*, perpendicular to first magnetic field 243*b* and second magnetic field 244*b* extending about parallel along rear side 202 towards a left edge or a right edge of rear side 202.

In other words, third NFC antenna 1244 is rotated about 90° with respect to second NFC antenna 144*b*, similar to second NFC antenna 144*a* of FIG. 11.

In some implementations, as depicted, third NFC antenna 1244 is of a similar type as second NFC antenna 144*b*: for example, in depicted implementations, both second NFC antenna 144*b* and third NFC antenna 1244 are bowtie coils.

However, in other implementations, second NFC antenna 144*b* and third NFC antenna 1244 can each be a different type of antenna; for example, second NFC antenna 144*b* can comprise a bowtie antenna and third NFC antenna 1244 can comprise a double D antenna rotated about 90° to second NFC antenna 144*b*. Indeed, it is appreciated that second NFC antenna 144*b* and third NFC antenna 1244 are fed from the same signal feed and are further placed to partially overlap to decouple them. For example, it is appreciated that two RF coils can be decoupled by overlapping them which enables the magnetic flux of each coil to pass through the other coil in the opposite direction in a non-overlapping area; the area of overlap can be adjusted such that the mutual inductance between the coils is cancelled by the flux through the overlapping area. While FIG. 12 does not strictly show second antenna 144*b* and third antenna 1244 overlapping, it is appreciated that they nonetheless overlap to decouple them from each other.

Figure 13:
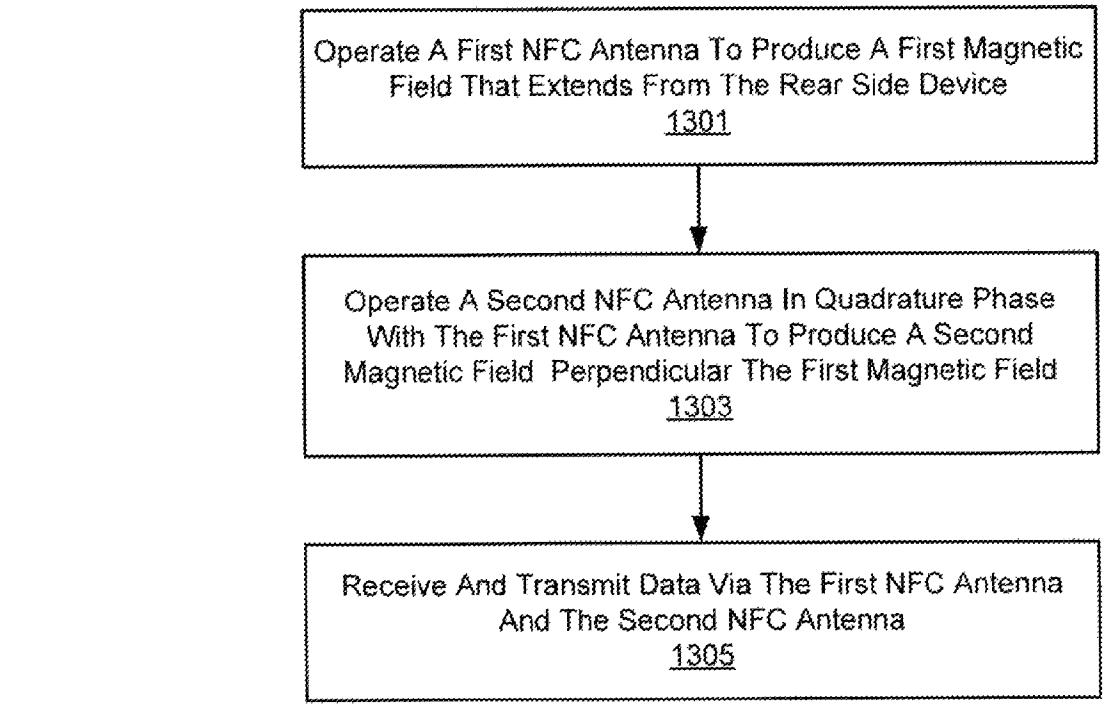
FIG. 13 depicts a flowchart of a method for operating a quadrature NFC antenna, according to non-limiting implementations.

Attention is now directed to FIG. 13 which depicts a flowchart of a method 1300 for operating a quadrature NFC antenna, according to non-limiting implementations. In order to assist in the explanation of method 1300, it will be assumed that method 1300 is performed using device 101. Furthermore, the following discussion of method 1300 will lead to a further understanding of device 101 and its various components. However, it is to be understood that device 101 and/or method 1300 can be varied, and need not work exactly as discussed herein in conjunction with each other, and that such variations are within the scope of present implementations.

It is appreciated that, in some implementations, method 1300 is implemented in device 101 by processor 120 and/or interface 124 and/or circuit 145. Indeed, method 1300 is one way in which device 101 can be configured. It is to be emphasized, however, that method 1300 need not be performed in the exact sequence as shown, unless otherwise indicated; and likewise various blocks may be performed in parallel rather than in sequence; hence the elements of method 1300 are referred to herein as "blocks" rather than "steps". It is also to be understood, however, that method 1300 can be implemented on variations of device 101 as well.

At block 1301, first NFC antenna 143 is operated to produce first magnetic field 243 that extends from rear side 202 of housing 109 of device 101, first NFC antenna 143 comprising a coil about parallel to a rear side 202 of housing 109, as described above with reference to FIGS. 1 to 3.

At block 1303, second NFC antenna 144 is operated in quadrature phase with first NFC antenna 143 to produce second magnetic field 244 perpendicular first magnetic field 143, second NFC antenna 144 about parallel With first NFC antenna 143, second NFC antenna 144 comprising at least one respective coil forming two opposing current loops enabled to produce second magnetic field 244, as described above with reference to FIGS. 1, 2, and 4 to 7.

At block 1305, data 901 is one or more of received and transmitted via first NFC antenna 143 and second NFC antenna 144.

It is appreciated that the order of blocks 1301 and 1303 is generally non-limiting and can be reversed, and/or blocks 1301 and 1303 can occur in parallel. Further, block 1305 can occur in parallel with one or more of blocks 1301 and 1303 and/or between blocks 1301 and 1303.

In implementations where device 101 comprises a third NFC antenna (for example as in device 101*b* depicted in FIG. 12), method 1300 can comprise a further block where the third NFC antenna is operated in quadrature phase with first NFC antenna 143 to produce a third magnetic field perpendicular first magnetic field 243 and second magnetic field 144, the third NFC antenna comprising at least two further coils enabled to produce the third magnetic field.

Persons skilled in the art will appreciate that there are yet more alternative implementations and modifications possible. For example, while second NFC antenna 144 and third NFC antenna 1244 have been described with respect to respective magnetic fields 244, 1245 extending along a rear side towards top side, a left side and a right side of devices 101, 101*b*, present implementations are not so limiting. For example, while second NFC antenna 144 and/or third NFC antenna 1244 can be at any angle relative to longitudinal axes of devices 101, 101*b* such that respective magnetic fields 244, 1245 extend along the rear side of devices 101, 101*b* at any corresponding angle. In other words, magnetic fields 244, 1245 produced by second NFC antenna 144 and/or third NFC antenna 1244 can be at any angle relative a longitudinal axis of either of devices 101, 101*b*, but about perpendicular to first magnetic field 243.

It is again to be emphasized that while present implementations will be described with reference to respective magnetic fields of each of first NFC antenna 143 and second NFC antenna 144 leaking from rear side 202 of device 101, in other implementations, first NFC antenna 143 and second NFC antenna 144 can be arranged such that respective magnetic fields 243, 244 leak from any given side of device 101 including, but not limited to, rear side 201, front side 201, a top side, a bottom side, a left side or a right side.

In any event, by providing at least a second NFC antenna producing at least a second magnetic field about perpendicular to a first magnetic field that extends from a given side of a device, the device can interact with external NFC devices without a grip on the device being adjusted so as to not be restricted to device alignment. This further extends coverage of the device for interacting with external NFC devices. It is further appreciated that such a device can further be used as a double resonance solution for separate optimization of NFC card readers and NFC card emulation modes: for example, each coil feed line can have a unique shunt capacitor (forming a respective LC tank resonator) to optimize individual antennas for card emulation and reader modes separately.

Those skilled in the art will appreciate that in some implementations, the functionality of devices 101, 101*a*, 101*b* can be implemented using pre-programmed hardware or firmware elements (e.g., application specific integrated circuits (ASICs), electrically erasable programmable read-only memories (EEPROMs), etc.), or other related components. In other implementations, the functionality of devices 101, 101*a*, 101*b* can be achieved using a computing apparatus that has access to a code memory (not shown) which stores computer-readable program code for operation of the computing apparatus. The computer-readable program code could be stored on a computer readable storage medium which is fixed, tangible and readable directly by these components, (e.g., removable diskette, CD-ROM, ROM, fixed disk, USB drive). Furthermore, it is appreciated that the computer-readable program can be stored as a computer program product comprising a computer usable medium. Further, a persistent storage device can comprise the computer readable program code. It is yet further appreciated that the computer-readable program code and/or computer usable medium can comprise a non-transitory computer-readable program code and/or non-transitory computer usable medium. Alternatively, the computer-readable program code could be stored remotely but transmittable to these components via a modem or other interface device connected to a network (including, without limitation, the Internet) over a transmission medium. The transmission medium can be either a non-mobile medium (e.g., optical and/or digital and/or analog communications lines) or a mobile medium (e.g., microwave, infrared, free-space optical or other transmission schemes) or a combination thereof.

A portion of the disclosure of this patent document contains material which is subject to copyright protection. The copyright owner has no objection to the facsimile reproduction by any one of the patent document or patent disclosure, as it appears in the Patent and Trademark Office patent file or records, but otherwise reserves all copyrights whatsoever.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A device comprising:

a housing;

a first NFC (near field communication) antenna comprising a coil about parallel to a given side of the housing configured to produce a first magnetic field that extends from the given side of the housing;

a second NFC antenna about parallel with the first NFC antenna, the second NFC antenna comprising at least one respective coil forming two opposing current loops configured to produce a second magnetic field perpendicular to the first magnetic field;

a third NFC antenna about parallel with the first NFC antenna and the second NFC antenna, the third NFC antenna comprising at least two further coils configured to produce a third magnetic field extending from the housing, perpendicular to the first magnetic field and the second magnetic field; and, a circuit for operating the first NFC antenna and the second NFC antenna in quadrature phase.

2. The device of claim 1, wherein the first NFC antenna comprises a loop antenna.

3. The device of claim 1, wherein current in the two opposing current loops of the at least one respective coil flows in opposite directions to produce the second magnetic field.

4. The device of claim 1, wherein the second NFC antenna comprises a bowtie antenna.

5. The device of claim 1, wherein the second NFC antenna comprises one or more of a bowtie antenna, a double D coil, a butterfly antenna and a figure eight antenna.

6. The device of claim 1, wherein the second magnetic field leaks from the given side of the housing, about parallel to the given side, when operated by the circuit.

7. The device of claim 1, further comprising a magnetic conductor for containing respective portions of the first magnetic field and the second magnetic field internal to the device such that at least a local net portion of the first magnetic field leaks from the given side of the housing perpendicular thereto and at least a respective local net portion of the second magnetic field leaks from the given side of the housing, about parallel to the given side, when operated by the circuit.

8. The device of claim 1, further comprising a processor configured to:

control the circuit; and, one or more of receive and transmit data via the first NFC antenna and the second NFC antenna.

9. The device of claim 1, wherein the first magnetic field and the second magnetic field form components of a circularly polarized magnetic field.

10. The device of claim 1, wherein the circuit comprises an LC (inductor-capacitor) quadrature splitter.

11. The device of claim 1, further comprising a transceiver in communication with the first NFC antenna and the second NFC antenna, and the circuit comprises a phase controlled differential driver of an RF interface of the transceiver.

12. The device of claim 1, wherein the third NFC antenna is partially overlapped with the second NFC antenna, and rotated about 90° thereto to decouple the third NFC antenna from the second NFC antenna.

13. An method comprising:

operating a first NFC (near field communication) antenna to produce a first magnetic field that extends from a given side of a housing of a device, the first NFC antenna comprising a coil about parallel to the given side of the housing;

operating a second NFC antenna in quadrature phase with the first NFC antenna to produce a second magnetic field perpendicular the first magnetic field, the second NFC antenna about parallel with the first NFC antenna, the second NFC antenna comprising at least one respective coil forming two opposing current loops configured to produce the second magnetic field; and, operating a third NFC antenna in quadrature phase with the first NFC antenna to produce a third magnetic field, the third NFC antenna about parallel with the first NFC antenna and the second NFC antenna, the third NFC antenna comprising at least two further coils configured to produce the third magnetic field extending from the housing, perpendicular to the first magnetic field and the second magnetic field.

14. The method of claim 13, further comprising one or more of receiving and transmitting data via the first NFC antenna and the second NFC antenna.

15. A non-transitory computer program product, comprising a computer usable medium having a computer readable program code adapted to be executed to implement a method comprising:

operating a first NFC (near field communication) antenna to produce a first magnetic field that extends from the given side of a housing of a device, the first NFC antenna comprising a coil about parallel to a given side of the housing;

operating a second NFC antenna in quadrature phase with the first NFC antenna to produce a second magnetic field extending from the housing perpendicular the first magnetic field, the second NFC antenna about parallel with the first NFC antenna, the second NFC antenna comprising at least one respective coil forming two opposing current loops configured to produce the second magnetic field; and, operating a third NFC antenna in quadrature phase with the first NFC antenna to produce a third magnetic field, the third NEC antenna about parallel with the first NFC antenna and the second NFC antenna, the third NFC antenna comprising at least two further coils configured to produce the third magnetic field extending from the housing, perpendicular to the first magnetic field and the second magnetic field.

16. The computer program product of claim 15, the method further comprising one or more of receiving and transmitting data via the first NFC antenna and the second NFC antenna.

* * * * *

UNITED STATES PATENT AND TRADEMARK OFFICE

CERTIFICATE OF CORRECTION

PATENT NO. : 9,099,765 B2
APPLICATION NO. : 13/542755
DATED : August 4, 2015
INVENTOR(S) : Rayhan Behin It is certified that error appears in the above-identified patent and that said Letters Patent is hereby corrected as shown below:

In the Claims

Column 14, line 43, Claim 15, "NEC" should read --NFC--.

Signed and Sealed this
Twenty-first Day of June, 2016

Michelle K. Lee

Michelle K. Lee
*Director of the United States Patent and Trademark Office*